US009629782B2

(12) United States Patent
Hayes

(10) Patent No.: US 9,629,782 B2
(45) Date of Patent: Apr. 25, 2017

(54) QUICK MIXING BABY FORMULA CYLINDER AND SYSTEM

(75) Inventor: Scott H. Hayes, Mooresville, NC (US)

(73) Assignee: Lacy Enterprises, Inc., Mooresville, NC (US)

( * ) Notice: Subject to any disclaimer, the term of this patent is extended or adjusted under 35 U.S.C. 154(b) by 1059 days.

(21) Appl. No.: 12/564,171

(22) Filed: Sep. 22, 2009

(65) Prior Publication Data

US 2010/0072160 A1 Mar. 25, 2010

Related U.S. Application Data

(63) Continuation-in-part of application No. 11/714,575, filed on Mar. 6, 2007, now Pat. No. 7,850,027.

(60) Provisional application No. 60/811,970, filed on Jun. 8, 2006.

(51) Int. Cl.

| | |
|---|---|
| ***A61J 9/00*** | (2006.01) |
| ***A61J 11/00*** | (2006.01) |
| ***A61J 11/04*** | (2006.01) |
| *A61J 1/20* | (2006.01) |

(52) U.S. Cl.

CPC ..... *A61J 9/008* (2013.01); *A61J 11/002* (2013.01); *A61J 11/008* (2013.01); *A61J 11/04* (2013.01); *A61J 1/2093* (2013.01)

(58) Field of Classification Search

CPC ..... A61J 1/20933; A61J 9/008

USPC ..... 215/11.1, DIG. 8, 11.4, 6; 206/221, 222

See application file for complete search history.

(56) References Cited

U.S. PATENT DOCUMENTS

| | | | | |
|---|---|---|---|---|
| 2,793,776 | A * | 5/1957 | Lipari | 206/221 |
| 2,977,015 | A | 3/1961 | Bartlett | |
| 4,498,613 | A * | 2/1985 | Donahue et al. | 224/251 |
| 4,779,722 | A | 10/1988 | Hall | |
| 4,979,629 | A | 12/1990 | Askerneese | |
| 5,060,811 | A * | 10/1991 | Fox | 215/6 |
| 5,088,627 | A * | 2/1992 | Musel | B65D 25/087 206/219 |
| 5,148,948 | A * | 9/1992 | Granville | A47K 5/12 222/153.09 |
| 5,275,298 | A | 1/1994 | Holley, Jr. et al. | |
| 5,295,597 | A * | 3/1994 | Green | 215/11.4 |

(Continued)

FOREIGN PATENT DOCUMENTS

| | | | |
|---|---|---|---|
| WO | WO 2005084135 A2 * | 9/2005 | |
| WO | WO 2009027981 A2 * | 3/2009 | |

OTHER PUBLICATIONS

Umix Travel Bottle, www.umix.com, date unknown, believed to be available as of filing date.

*Primary Examiner* — Sue A Weaver

(74) *Attorney, Agent, or Firm* — Jeffrey C. Watson; Grell & Watson Patent Attorneys

(57) ABSTRACT

An apparatus for a baby bottle container may include a plug assembly. A plug assembly may include a wall forming an inner volume. A plug may extend from the wall and form a portion of the inner volume. The plug assembly may be capable of removable attachment to a baby bottle container. An apparatus for a baby bottle container may include a chamber assembly capable of removable attachment to the plug assembly. The chamber assembly may comprise a partition configured to receive a portion of the plug within the inner volume of the plug assembly. The chamber assembly may be axially slidable about the plug assembly to selectively engage the partition with the plug to form a seal.

20 Claims, 12 Drawing Sheets

(56) References Cited

U.S. PATENT DOCUMENTS

| | | | | |
|---|---|---|---|---|
| 5,419,445 | A | 5/1995 | Kaesemeyer | |
| 5,433,328 | A * | 7/1995 | Baron et al. | 215/11.4 |
| 5,564,600 | A * | 10/1996 | Renault | 222/129 |
| 5,634,714 | A | 6/1997 | Guild | |
| 5,638,968 | A * | 6/1997 | Baron et al. | 215/11.4 |
| 5,794,802 | A | 8/1998 | Caola | |
| 5,863,126 | A | 1/1999 | Guild | |
| 5,875,888 | A | 3/1999 | Albisetti | |
| 5,890,627 | A | 4/1999 | Storey | |
| 6,045,254 | A | 4/2000 | Inbar et al. | |
| 6,113,257 | A | 9/2000 | Sharon et al. | |
| 6,257,428 | B1 | 7/2001 | Caola | |
| 6,705,491 | B1 | 3/2004 | Lizerbram et al. | |
| 6,945,393 | B2 | 9/2005 | Cho | |
| 6,994,211 | B2 * | 2/2006 | Cho | 206/221 |
| 7,055,685 | B1 | 6/2006 | Patterson et al. | |
| 7,150,369 | B1 | 12/2006 | Fryar | |
| 7,331,478 | B2 | 2/2008 | Aljadi | |
| 7,464,811 | B2 * | 12/2008 | Patterson et al. | 206/220 |
| 7,484,633 | B1 | 2/2009 | Moher | |
| 7,503,453 | B2 * | 3/2009 | Cronin et al. | 206/221 |
| 7,740,134 | B2 * | 6/2010 | Sweeney, Jr. | B65D 51/2864 206/221 |
| 7,861,854 | B2 * | 1/2011 | Sharon et al. | 206/221 |
| 8,528,756 | B2 * | 9/2013 | Itzek | A61J 11/04 215/11.4 |
| 8,556,103 | B2 * | 10/2013 | Tiesberger | B65D 51/2864 206/219 |
| 2003/0192851 | A1 * | 10/2003 | Ziegler | 215/11.5 |
| 2007/0074979 | A1 * | 4/2007 | Cho | 206/219 |
| 2009/0178940 | A1 * | 7/2009 | Said | 206/221 |

* cited by examiner

QUICK MIXING BABY FORMULA CYLINDER AND SYSTEM

CROSS REFERENCE TO RELATED APPLICATION

This patent application is a continuation-in-part of U.S. application Ser. No. 11/714,575 filed Mar. 6, 2007, the entirety of which is incorporated by reference herein, and which claims priority from U.S. Provisional Patent Application Ser. No. 60/811,970 filed Jun. 8, 2006.

FIELD OF THE INVENTION

The present invention relates, in general, to baby formula bottles and, more particularly, this invention relates to an improved method for transporting and quickly mixing dry formula and water.

BACKGROUND OF THE INVENTION

Powder baby formula is typically measured in proper ratio to the amount of water in the bottle and then immediately added to the water and mixed just minutes prior to consumption. This approach presents no difficulty at home, but it does impose an inconvenience to the parents or caregivers while traveling. In fact, use of liquid formulas is more prevalent at home. Infants require frequent feeding and liquid formula bottles or milk require refrigeration to prevent spoilage, and heating is required prior to consumption. While the refrigeration and heating can be avoided by blending a powder and water just prior to consumption, this poses an inconvenience and potentially messy situation while traveling.

Numerous, somewhat elaborate, devices have been disclosed for storing a formula powder within a bottle until just prior to consumption, with provisions for rapidly combining and mixing the liquid and powder without opening the bottle. Some represent a whole new bottle design while others are made to fit into a standard bottle arrangement. These prior attempts push a portion of the sealing mechanism into the lower water compartment at the time of mixing, and it must be retrieved and reassembled later.

Thus, there is a need for an improved bottle system that allows a user to keep separate dry powder and water, and quickly mix the powder and water for consumption by an infant as needed.

SUMMARY OF THE INVENTION

An apparatus for a baby bottle container may include a plug assembly. A plug assembly may include a wall forming an inner volume. A plug may extend from the wall and form a portion of the inner volume. The plug assembly may be capable of removable attachment to a baby bottle container. An apparatus for a baby bottle container may include a chamber assembly capable of removable attachment to the plug assembly. The chamber assembly may comprise a partition configured to receive a portion of the plug within the inner volume of the plug assembly. The chamber assembly may be axially slidable about the plug assembly to selectively engage the partition with the plug to form a seal.

In another embodiment, the invention may include an apparatus for selectively separating and mixing components in a baby bottle container. The apparatus may include a plug assembly capable of removable attachment on the baby bottle container. The plug assembly may include a plug. The apparatus may include a chamber assembly capable of removable attachment to the plug assembly. The chamber assembly may include a partition capable of receiving the plug to form a seal. The chamber assembly may be capable of axial slidable engagement with the plug assembly so that when the partition receives the plug to form the seal, the seal separates a first compartment in the chamber assembly and a second compartment in the container.

BRIEF DESCRIPTION OF THE DRAWINGS

FIG. 10A is an exploded assembly view of the bottle system shown in

FIG. 8.

DETAILED DESCRIPTION

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention cover such modifications and variations as come within the scope of the appended claims and their equivalents.

Figure 2:
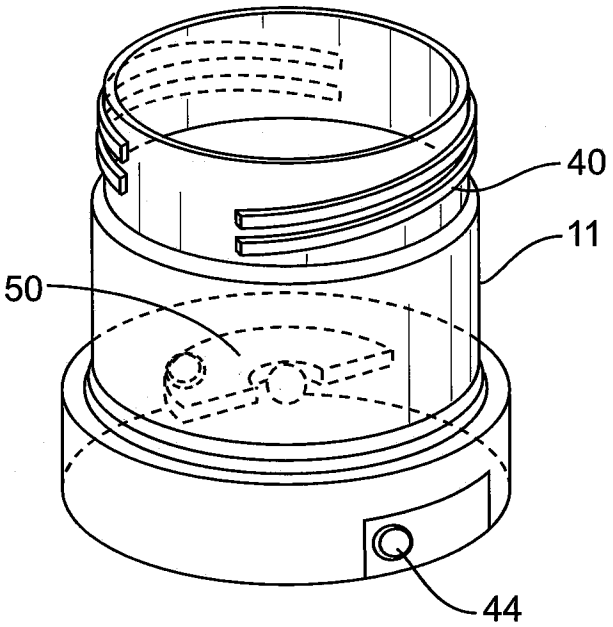
FIG. 2 is a perspective view of the upper chamber of the cylinder attachment.
Figure 1:
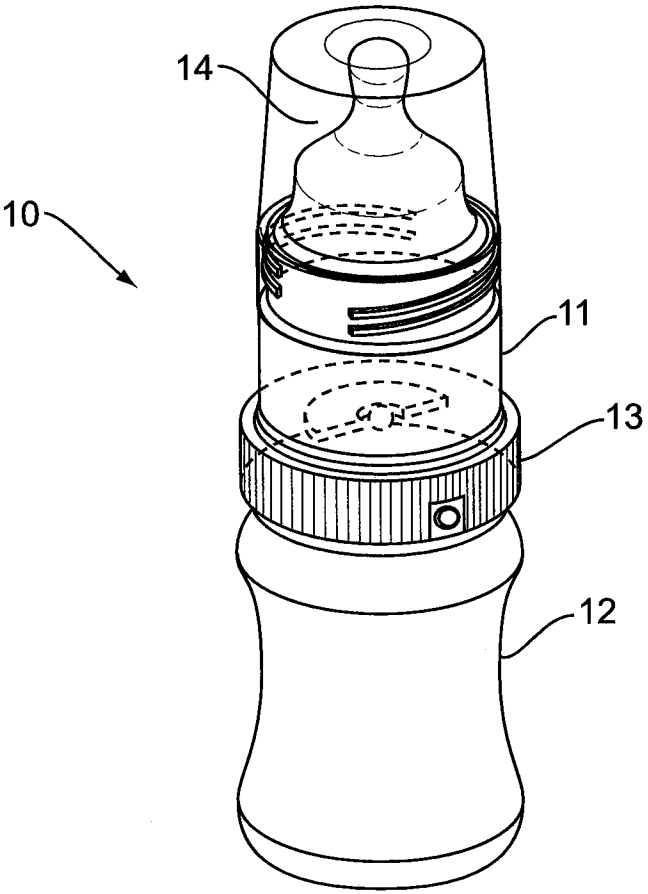
FIG. 1 is an overview of an infant feeding bottle unit with the cylinder invention assembled between the bottle and nipple.

Referring initially to FIG. 1, a bottle and formula cylinder arrangement, generally designated 10, is shown with a cylinder 11 attached to a standard baby bottle 12 below via the lower ring 13, and also attached to a standard nipple and cover assembly 14 above. As shown in FIG. 2 the upper cylinder 11 includes the upper aperture 50, the release button 44, and the nipple mating threads 40.

Figure 3:
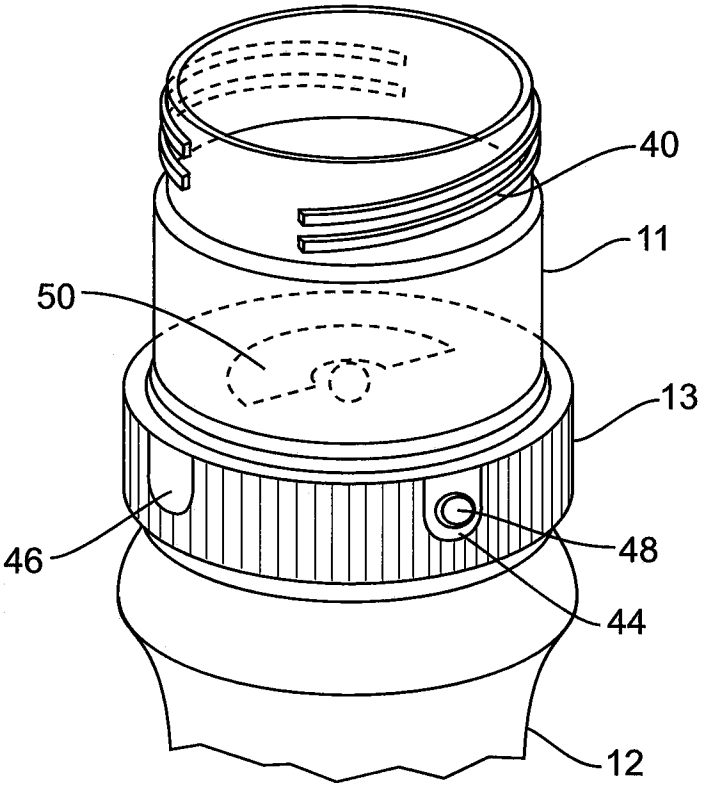
FIG. 3 is a perspective view of the upper chamber being held by a lower mounting ring to the top of a standard plastic baby bottle.

Referring to FIG. 3, the preferred embodiment of the invention is depicted mounted on the top of a standard baby bottle 12. A cylindrical chamber 11 holds and keeps the powder dry until a release button 44 is depressed at "Closed" notch 46-in bottom ring 13 allowing the cylinder 11 to be rotated to "Open" position 48, whereupon button 44 is released. This rotation aligns the aperture 50 with an aperture of similar size and shape in a horizontal partition across the open area of a ring 13. Mating thread 40 is available for screwing on a standard nipple assembly.

Figure 4:
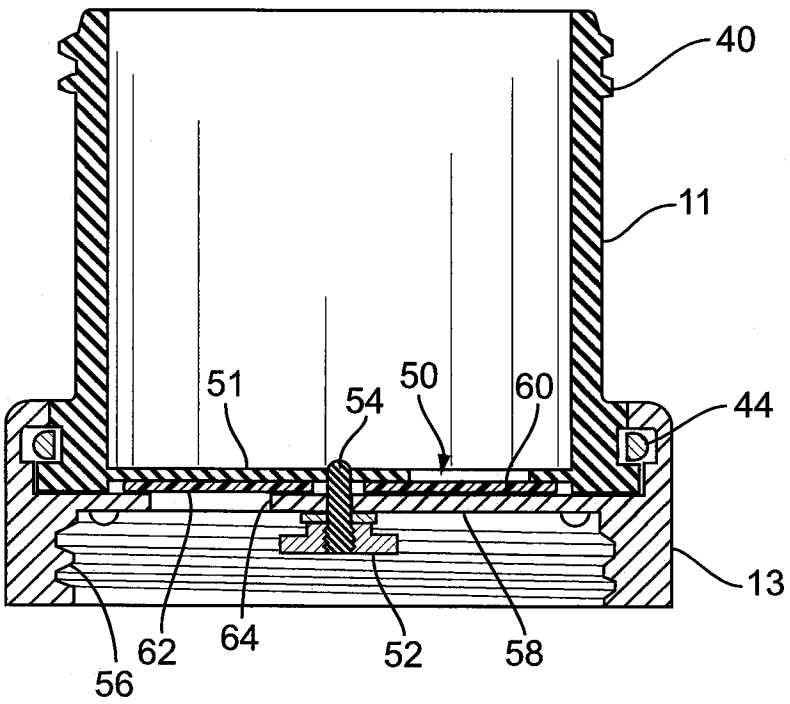
FIG. 4 is an elevation sectional view of the formula cylinder apparatus.

FIG. 4 provides a vertical sectional view of a two-button version of the presently preferred embodiment with additional construction details. The upper chamber 11 is connected to the ring 13 by the combination of a bolt 54 fused to the bottom 51 at the central axis and a nut 52 screwed onto bolt 54 beneath the horizontal partition 58 that is integral to ring 13. There are comparable apertures 50 in the bottom floor 51 and 64 in the horizontal partition 58. When in the closed position, the two apertures are sealed by rubber like pads 60 and 62 of slightly larger size adhered to a solid surface of the opposing partitions, 58 and 51 respectively.

Figure 5:
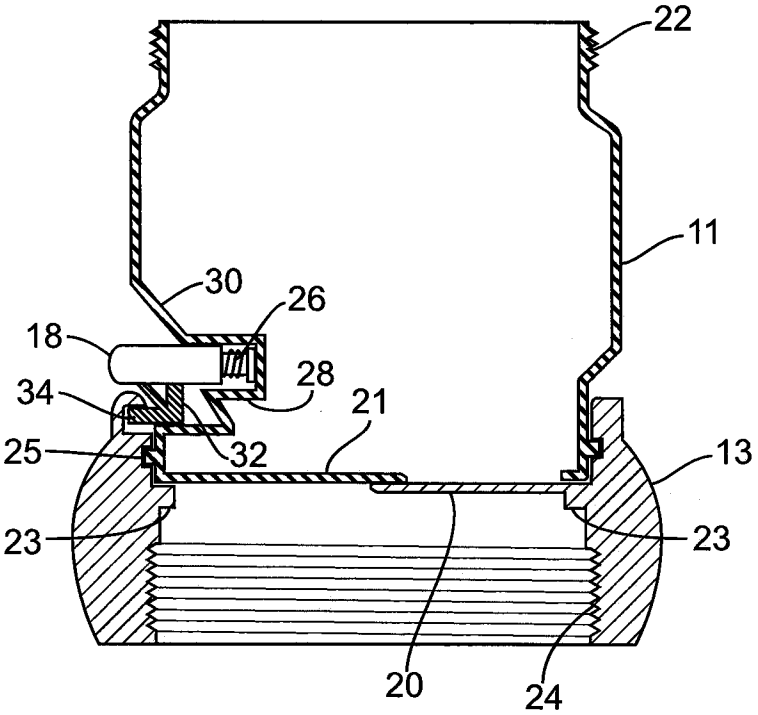
FIG. 5 is an elevation sectional view of a second embodiment of the invention.

FIG. 5 is a vertical sectional view of a second embodiment cutting through the release button 18 longitudinally, and showing both the upper cylinder 11 with its nipple mating threads 22, and the lower attachment ring 13. Above the bottle mating threads 24, the lower ring 13 has a built-in horizontal member that covers about half of the cross section area defined by the inside diameter of ring 13. Also built into the upper inside surface of attachment ring 13 are a circumferential ledge 23, a circumferential groove 25, and a cavity 34. Release button 18 has an attached leg 32 that engages with cavity 34. Also attached to button 18 is a spring 26 that fits into the cavity 28 molded into recessed area 30 of the upper cylinder 11. The cylinder 11 has a floor 21 across slightly more than half of the bottom area.

Figure 6:
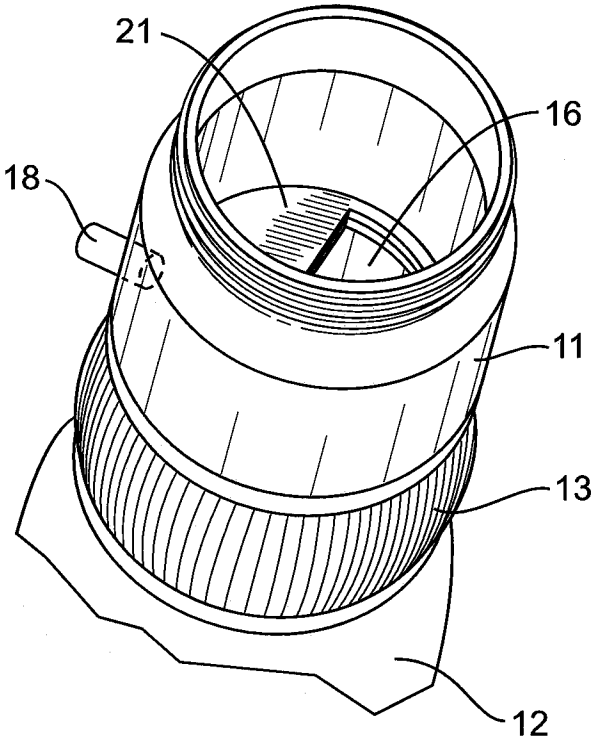
FIG. 6 is a perspective view of the second embodiment of the invention.

FIG. 6 is a perspective view from above with the two apertures aligned to create an opening 16. When the user desires to blend the formula powder stored in cylinder 11 with the water in the bottle 12, the release button 18 is depressed and held in while rotating the upper cylinder 11 approximately 180 degrees until the floor 21 is in position to create the opening 16 that will readily allow the powder to drop and be mixed with the water. The opening 16 remains while the prepared formula is fed to the infant.

Figure 7:
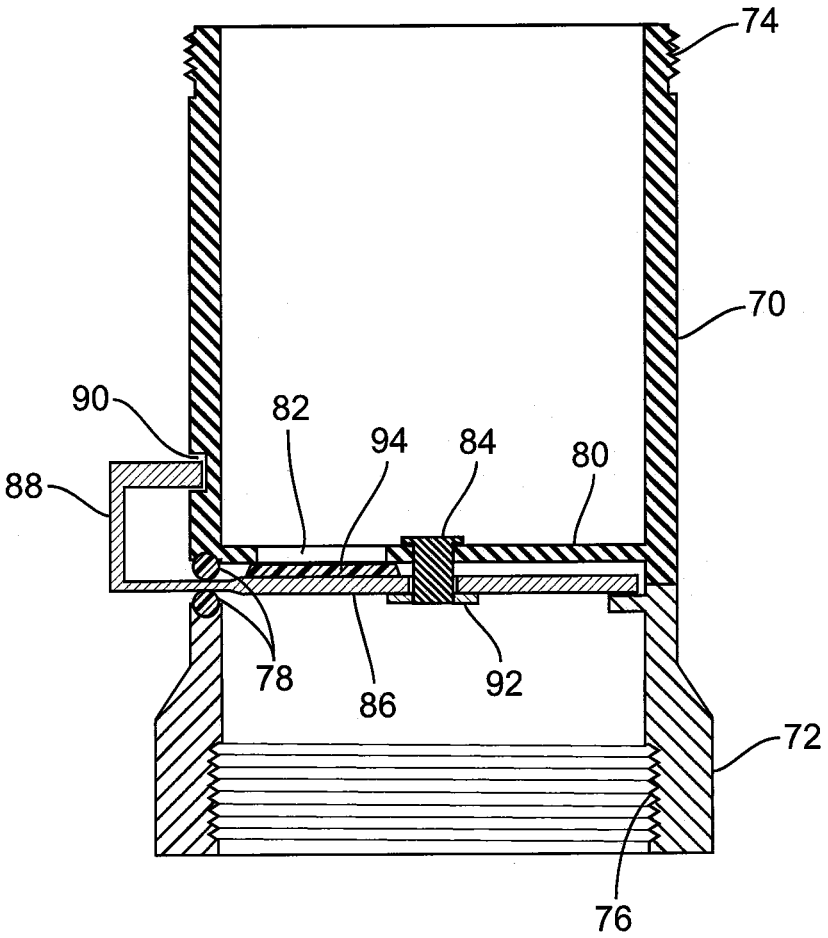
FIG. 7 is an elevation sectional view of a third embodiment of the invention.
Figure 8:
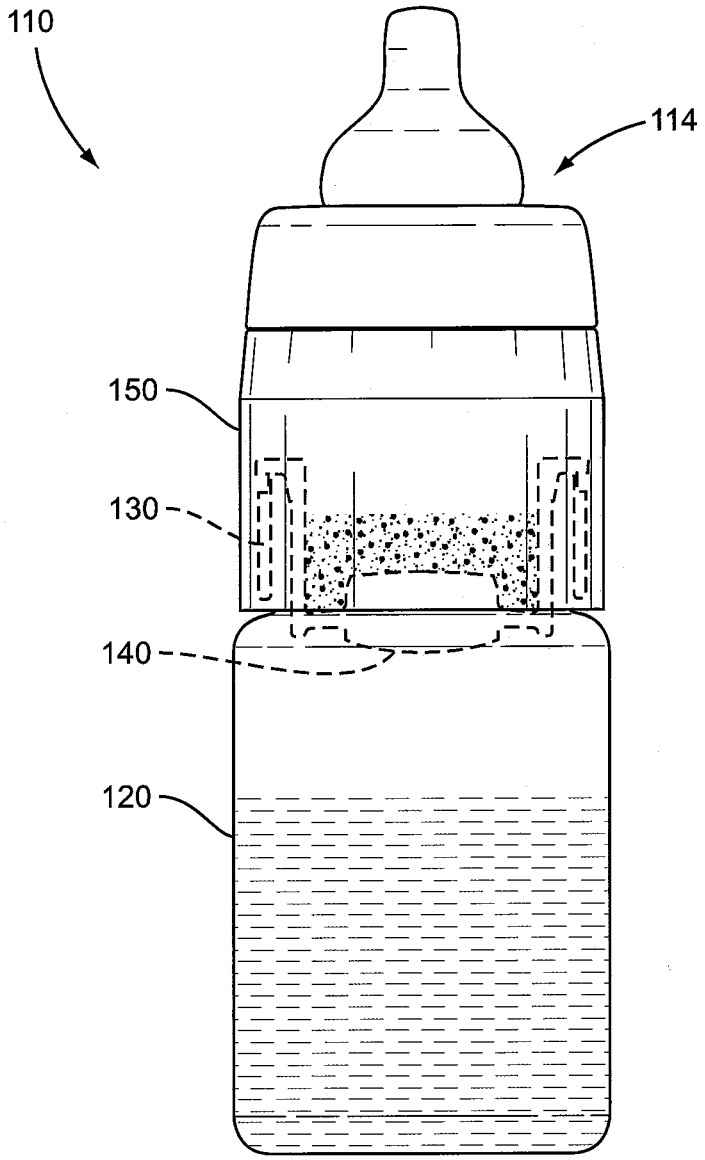
FIG. 8 is a side view of a fourth embodiment of a bottle system showing the powder formula and water held separately.

A third embodiment of the invention is shown in FIG. 7 via a vertical sectional view of the device. The upper cylindrical chamber 70 having external threads adjacent the top end, for mating to a standard baby bottle nipple, is fused at three-quarters of its bottom periphery, to lower ring 72, which has internal threads 76 to mate to a standard baby bottle. Where the other one-quarter of the bottom edge of cylindrical chamber 70 abuts the top edge of ring 72. Rubber-like partial 0-rings 78 are imbedded in the edge such that the two partial 0-rings 78 are tightly compressed against one another. The cylindrical chamber 70, has a bottom floor 80 with a sizeable off-center aperture 82 and a central fused-in pin 84.

Suspended just below the bottom floor 80 is a rotatable horizontal disc 86 with a central orifice slightly larger than the outer diameter of central pin 84. Adhered to the top surface of disc 86 is a rubber-like seal pad 94 covering an area slightly larger than that of aperture 82. Horizontal disc 86 is held in place on central pin 84 by a fused on washer 92 such that disc 86 is still free to rotate while seal pad 94 is held against the underside of floor 80 sufficiently to prevent water leakage past it. Disc 86 also has an off-center aperture comparable in size and shape to aperture 82, and this aperture in disc 86 is centered about 90 degrees from seal pad 94.

A substantially U-shaped tab 88 is fused at one location on the periphery of disc 86 and extends outward between 0-rings 78 with the distal end engaging one of two notches 90 built into the outer surface of cylindrical chamber 70. When in the closed position, seal pad 94 covers the floor aperture 82 and disc 86 is prevented from rotating by tab 88 engaged in a notch 90.

When the user wishes to mix the two ingredients, the tab 88 is pulled back to release it from the "Closed" notch, and tab 88 is then slid about 90 degrees and released into the "Open" notch. This aligns the two apertures and allows the powder to drop into the water and be mixed by shaking. The "Open" position is maintained for feeding the baby.

Figure 9:
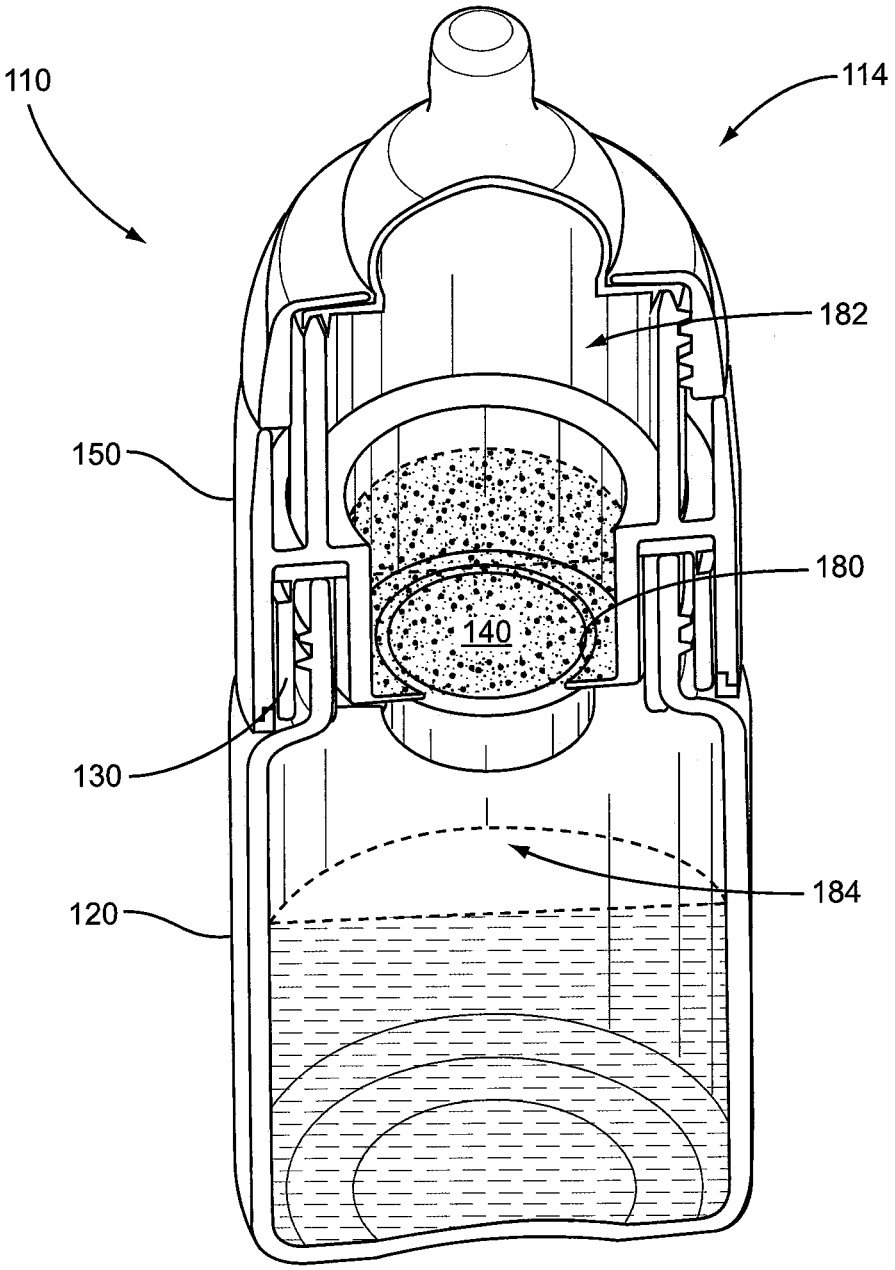
FIG. 9 is a top perspective cutaway view of a fourth embodiment of a bottle system shown in FIG. 8.

A fourth embodiment of the invention is shown in FIGS. 8 through 14. The bottle system 110 shown in FIGS. 8, 9, 10A and 10B may include a nipple assembly 114, chamber assembly 150, plug assembly 130, plug 140 and a bottle 120. The chamber assembly 150 and the plug assembly 130 cooperate to form the seal 180 in the bottle system 110. As shown in FIG. 9, the seal 180 includes a partition 160 and plug 140 in contact and that separate the first and second compartments 182 and 184. The compartments may separately hold water and/or powdered formula.

Figure 10A:
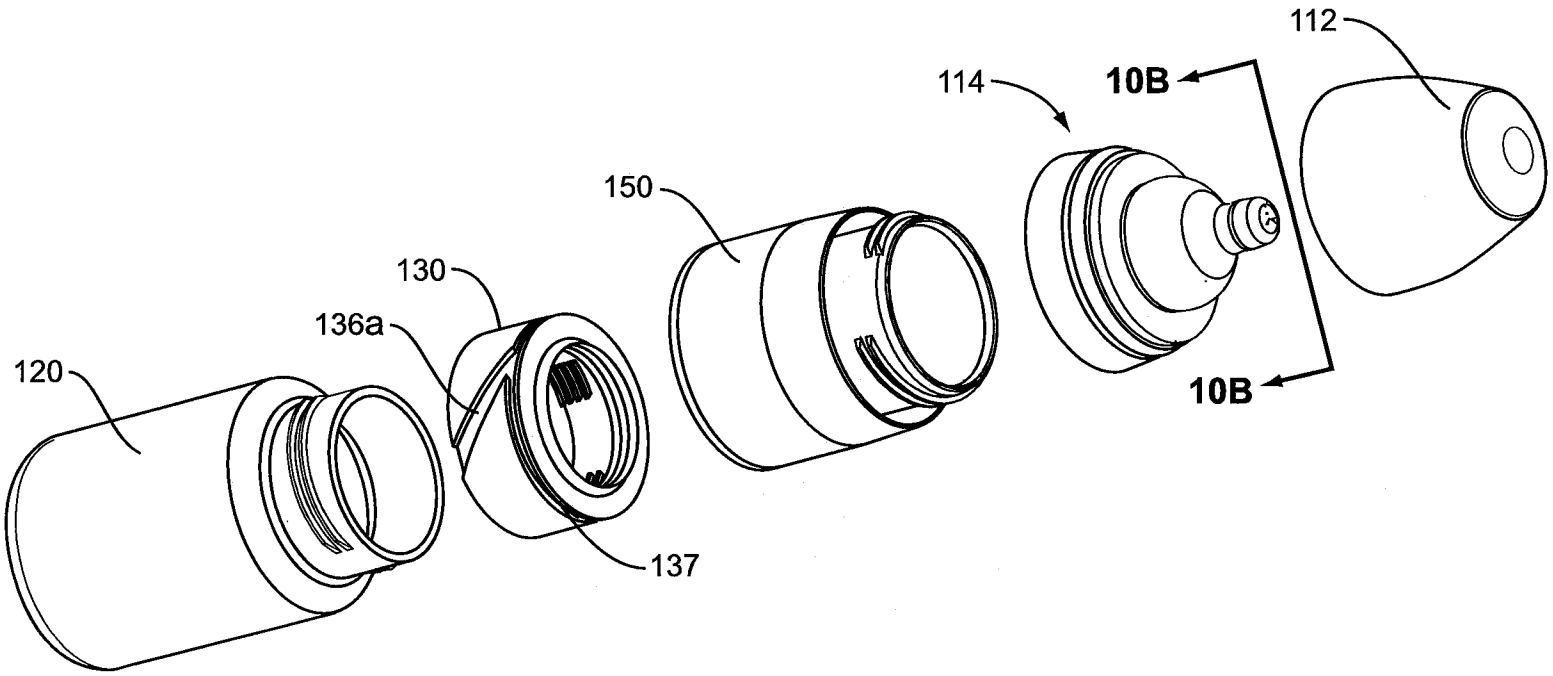

As shown in FIG. 10A, the plug assembly 130 may have a groove 137 for receiving an o-ring, gasket, or other type of sealant. The groove 137 and o-ring (not shown) may minimize water, or mixed formula, from leaking out of the bottle system 110 during feeding or mixing. In addition, the groove 137 and o-ring may limit movement of the chamber assembly 150 when using the bottle system 110, as will be discussed below.

Referring to FIG. 9, a user may add the desired amount of water to the bottle 120. The plug and chamber assemblies 130 and 150 may then be attached to the bottle 120 with a seal 180 forming the first and second compartments 182 and 184. A user may add powdered formula to the first compartment 182. A nipple assembly 114 may then be attached to the chamber assembly 150 closing the bottle system 110.

Figure 10B:
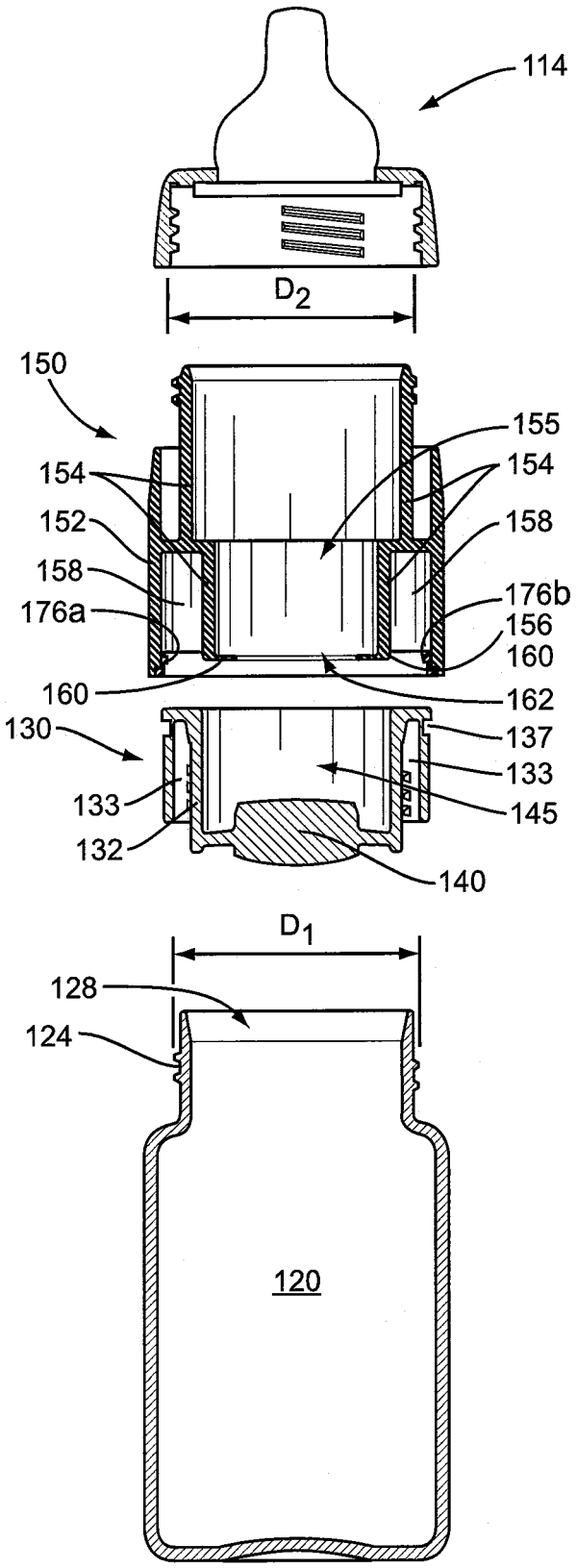
FIG. 10B shows an exploded assembly section of the bottle system taken along line 10B-10B.

As shown in FIG. 10B, the chamber and plug assembly 130 and 150 are configured for use with standard baby bottles and/or nipple assemblies. A standard baby bottle may have a neck opening 128 with a diameter, D1, between about 1 inch (2.54 cm) and about 3 inches (7.62 cm). A standard nipple assembly may have a diameter, D2, between about 1.25 inches and about 3.25 inches (8.255 cm). In an embodiment, the neck opening 128 has a D1 of about 2 inches (5.08 cm) and the nipple assembly has a D2 of about 2.25 inches (5.715 cm). In other embodiments, the chamber and plug assembly 130 and 150 may be configured for use with any sized bottle and nipple assembly.

As shown in FIGS. 10A through 11D, the plug assembly 130 may include a wall 132, a first and second track 136*a* and 136*b*. The wall 132 may be configured to receive the neck 124 of the bottle 120. The tracks 136*a* and 136*b* may guide and secure the chamber assembly 150 during use, as will be described below. The plug assembly 130 may be removably attached to the bottle 120. For example, the plug assembly may include threads for removable securement to the bottle 120.

As shown in FIGS. 10A, 11A, 11B, 11C and 11D, tracks 136*a* and 136*b* cooperate with a snap ring 172 included on the bottom portion of the chamber assembly 150. The snap-ring 172 limits separability of the chamber assembly 150 and plug assembly 130, making it difficult to inadvertently pull the chamber assembly 150 off of the plug assembly 130 during feeding.

Figure 11B:
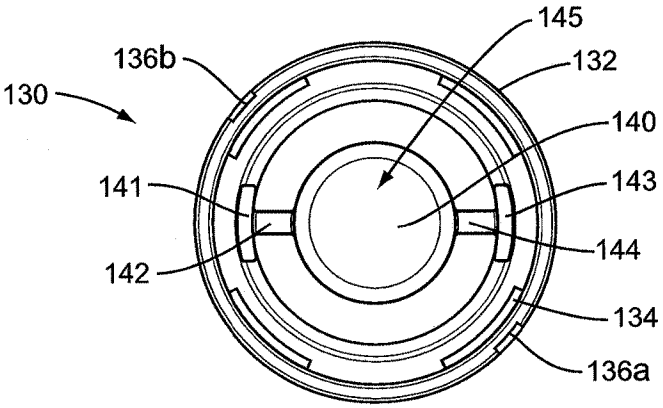
FIGS. 11A, 11B, 11C and 11D show top perspective, top, side and bottom perspective views of a plug assembly used in a fourth embodiment of a bottle system.
Figure 11D:
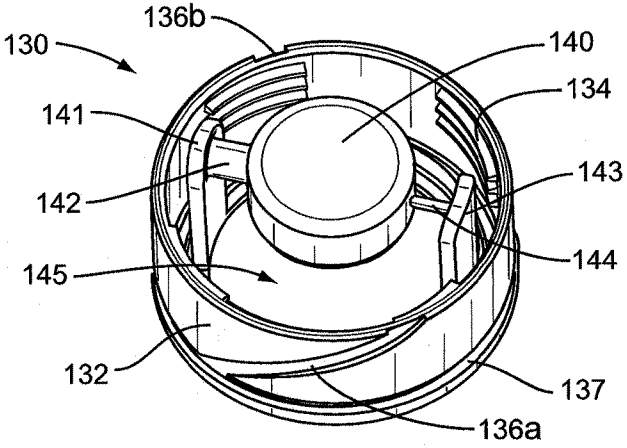
Figure 11A:
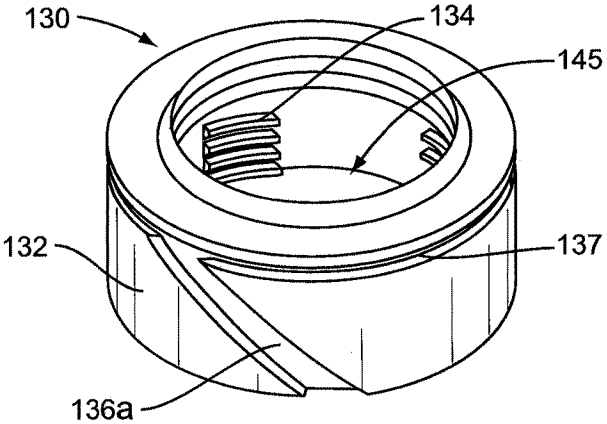
Figure 11C:
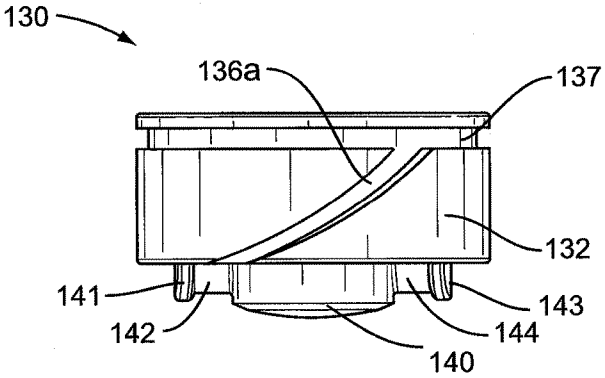

As shown in FIGS. 11B, 11C and 11D, plug 140 may be suspended from the wall 132 and comprise a portion of the inner volume 145. The inner volume 145 of the plug assembly 130 as used herein refers to the open space within the wall 132 of the plug assembly 130. Extending from the wall 132 may be partial inner walls 141 and 143, and bridge connectors 142 and 144, respectively. In an embodiment, the partial inner walls 141 and 143 and bridge connectors 142 and 144 suspended the plug 140 in the inner volume 145.

A bridge connector may be a cylinder, rod, block, screw, or other structure that suspends the plug 140 within at least a portion of the inner volume 145 of the plug assembly 130. In an embodiment, the bridge connectors 142 and 144 and plug 140 may be a single integral structure with the plug assembly 130. In other alternate embodiments, the plug 140, partial inner walls and bridges 142 and 144 may be separately formed, combined and connected to the plug assembly 130. In other embodiments, multiple bridge connectors, or partial walls 141 and 143 may be used. In still other alternate embodiments, a single inner wall may be used with bridge connectors to suspend the plug 140.

The bridge connectors 142 and 144 may have a profile configured to facilitate flow of the baby formula through the bottle system 110 into the nipple and delivered to the infant. For example, the bridge connectors 142 and 144 may be oriented at opposing acute angles measured with respect to the centerline axis of plug 140. The arrangement of the bridge connectors 142 and 144 as shown may facilitate a circular like flow of the water and formula during mixing. Further, the circular-like flow of the mixed fluid in the bottle system may limit presence of excess air entering the nipple assembly and infant during feeding.

As shown in FIG. 10B, the chamber assembly 150 includes an outer wall 152, an inner wall 154 and an inner volume 155. The outer wall 152 and the inner wall 154 form a lower cavity 158 that extends circumferentially around the bottom portion of the chamber assembly 150. The cavity 158 may be sized to receive the plug assembly wall 132, while the inner volume 145 of the plug assembly receives the inner wall 154 of the chamber assembly 150.

The inner wall 154 may form the outer surface of the first compartment 182 (not numbered in FIG. 10B for illustrative purposes). In an embodiment, the inner wall 154 is connected to the outer wall 152. In other embodiments, the inner wall 154 may extend from any part of the outer wall 152 of the chamber assembly 150.

Figure 12B:
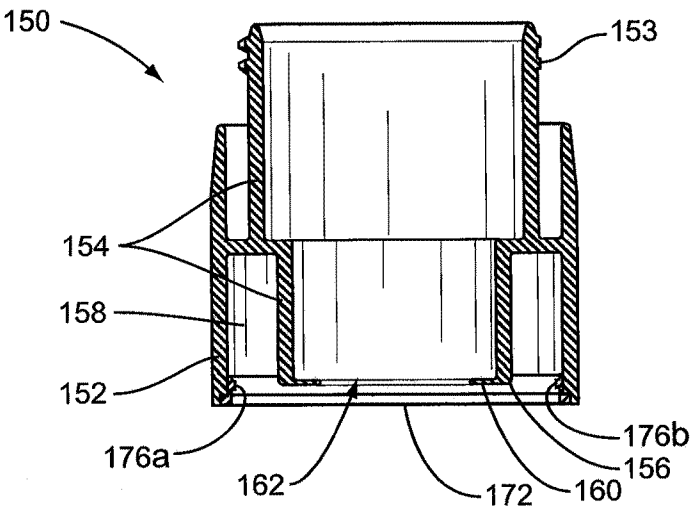
FIG. 12B is cross section taken along the line 12B-12B.
Figure 12C:
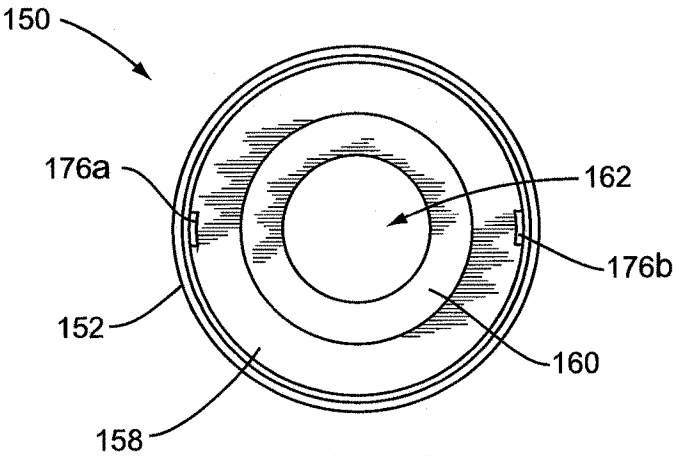
FIGS. 12A and 12C show top perspective and bottom views of a chamber assembly used in a fourth embodiment of a bottle system, respectively.
Figure 12A:
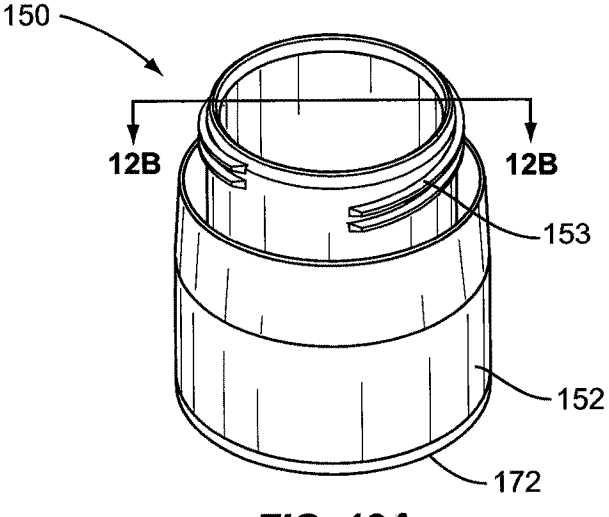

As shown in FIG. 12B, the distal end 156 of the inner wall 154 is a partition 160 forming an opening 162. The opening 162 is configured to receive the plug 140 of the plug assembly 130, and thus may form a seal 180 as discussed above.

Figure 13C:
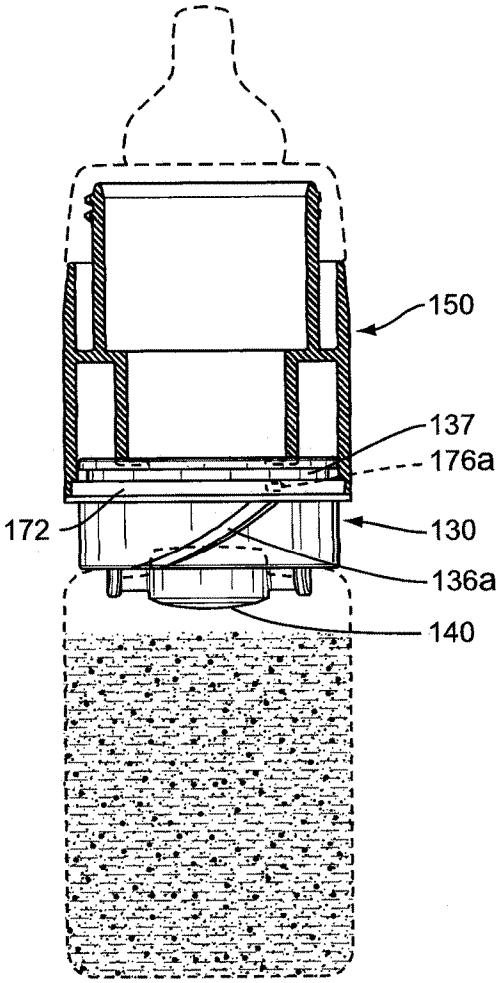
FIGS. 13A, 13B and 13C show partial cross sections (taken along lines 12B-12B) and partial hidden views of a fourth embodiment of the bottle system.

As shown in FIGS. 12B through 13C, tabs 176*a* and 176*b* on the bottom portion of the chamber assembly 150 engage the tracks 136*a* and 136*b* of the plug assembly 130. Tabs 176*a* and 176*b* are shown substantially orthogonal to the outer wall 152. As shown in FIGS. 13A, 1B and 13C, the tabs 176*a* and 176*b* (176*b* not shown) guide the chamber assembly 150 along the tracks 136*a* and 136*b* (136*b* not shown) to selectively open and close the seal 180. In the embodiment shown, a snap-ring 172 including the two tabs 176 may be snap-fitted into the bottom portion of the chamber assembly 150. In other embodiments, the tabs 176*a* and 176*b* may be integrally formed with the chamber assembly 150.

Figure 13B:
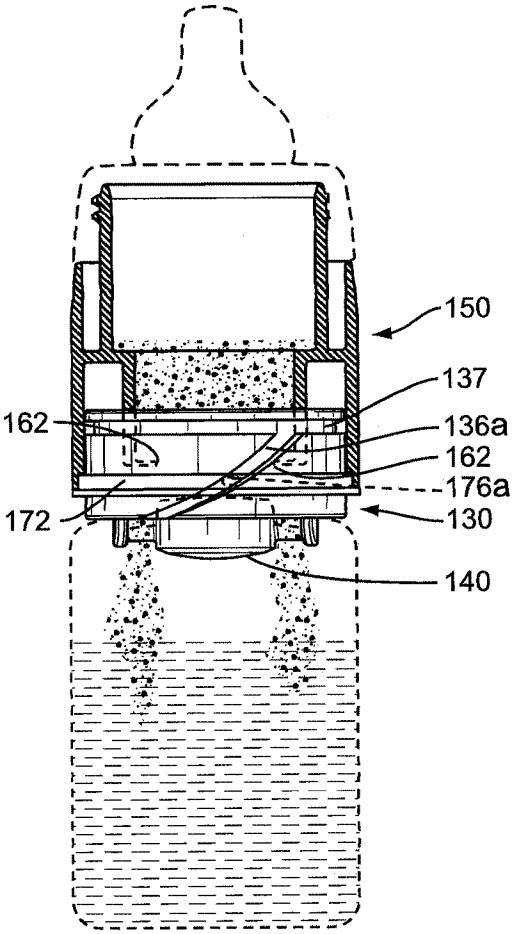
Figure 13A:
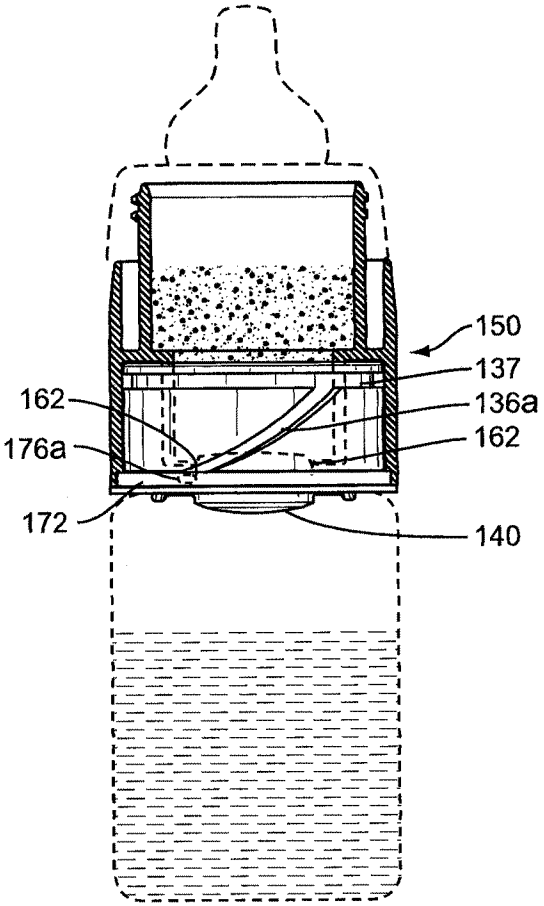

FIGS. 13A through 13C show how the chamber assembly 150 and the plug assembly 130 cooperate to selectively open and close the seal 180, allowing a user to mix the water and powder formula as needed. FIG. 13A shows the chamber assembly 150 at its lowest position on the plug assembly 130, with a partition 162 forming a seal 180 with a plug 140. The seal 180 separates the powdered formula and water in the first 182 and second compartments 184, as shown in FIG. 9 and discussed above.

The chamber assembly 150 may be rotated to open the seal 180 allowing a user to mix the powder formula and water. As a user rotates the chamber assembly 150, the tab 176*a* is guided by the track 136*a* displacing the partition 160 away from the stationary plug 140. When the partition 160 and plug 140 separate as shown in FIGS. 13B and 13C, a combined compartment is created that allows the powdered formula and water in the bottle system 110 to be mixed.

Figure 14:
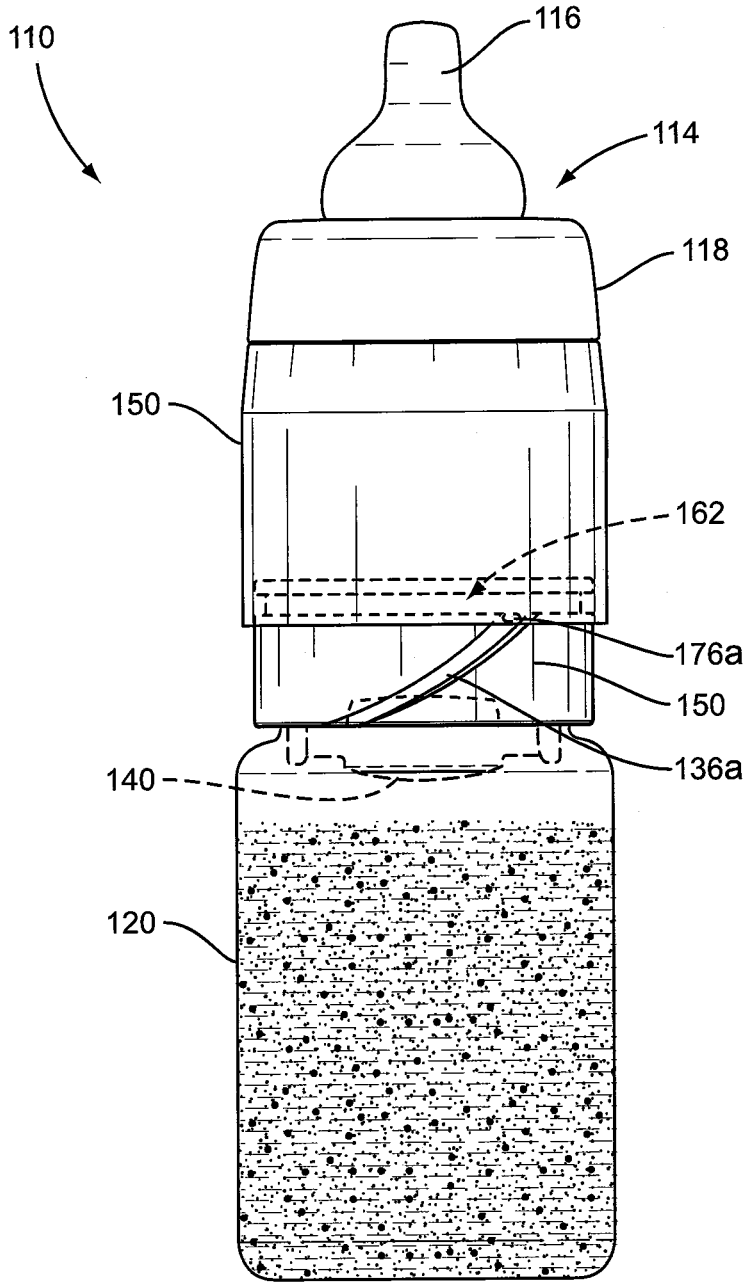
FIG. 14 is a side view of a bottle system with the powder formula and water combined.

As shown in FIGS. 13C and 14, as the chamber assembly 150 is further rotated around the plug assembly 130, the tab 176*a* engages groove 137 and o-ring (o-ring not shown). The chamber assembly 150 may be selectively locked with the aid of an o-ring so that the partition 162 and plug 130 remain open. Further, the chamber assembly 150 and plug assembly 130 remain difficult to disassemble while feeding or mixing while in the open, selectively locked position. With tab 176*a* (or 176*b*) at the groove 137, the displacement of the partition 162 away from the plug 140 is maintained as the bottle system is being used. FIG. 14 shows the bottle system 110 with the chamber assembly 150 in its extended position above the plug 140 and bottle 120. A user may reform the seal 180 as needed by rotating the chamber assembly 150 downward toward the bottle 20, with the tabs 176 guided by tracks 136 resealing the partition 162 and plug 140.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

I claim:

1. A baby bottle container, the container comprising:

a plug assembly comprising:

a wall, the wall forming an inner volume, a plug extending from the wall, said plug being attached to said wall by at least one partial inner wall oriented parallel to said wall in said plug assembly, and at least one bridge connector at the distal end of one of the at least one partial inner walls, said at least one bridge connector being oriented perpendicular to said wall and suspending said plug within at least a portion of the inner volume of the plug assembly, said at least one bridge connector oriented to facilitate a circular like flow during mixing;

the plug assembly being removably attached to the baby bottle container via the wall; and a chamber assembly comprising, an inner wall having a partition at a distal end forming an opening, said partition being configured to receive the plug within the inner volume of the plug assembly, where said partition forming a seal around said plug, the chamber assembly being axially slidable about the plug assembly to selectively engage the partition with the plug to form said seal.

2. The baby bottle container of claim 1, wherein when the seal forms a first compartment above the seal in said chamber assembly and a second compartment below the seal in the bottle container.

3. The baby bottle container of claim 2, wherein the chamber assembly is axially slidable to remove the partition from the plug so that components held in either of the first and second compartments can be mixed.

4. The baby bottle container of claim 1, wherein the chamber assembly has an outer wall connected to the inner wall, the inner and outer wall forming a cavity capable of receiving the plug assembly.

5. The baby bottle container of claim 4, wherein the partition is on an end of the inner wall, the inner wall and the partition are capable of being received by the inner volume of the plug assembly.

6. The baby bottle container of claim 1, wherein the plug assembly has at least one track for receiving the chamber assembly.

7. The baby bottle container of claim 1, further comprising a nipple assembly being removably attached to the chamber assembly.

8. The baby bottle container of claim 1, wherein the plug assembly and the chamber assembly can be used on any baby bottle container having a neck opening with a diameter between about 1 inches to about 3 inches.

9. The baby bottle container of claim 1, wherein said at least one bridge connector having a profile configured to facilitate flow of fluid through the bottle system.

10. The baby bottle container of claim 1, wherein, the chamber assembly including at least one tab on a bottom portion of the chamber assembly adapted to engage a corresponding amount of tracks of the plug assembly, where the at least one tab being axially slidable about the plug assembly to selectively engage the partition with the plug to form said seal; and when said chamber assembly being rotated open, said at least one tab being adapted to engage a groove in said plug assembly, whereby the chamber assembly may be locked so that said partition and said plug remain open.

11. The baby bottle container of claim 10 further comprising a snap ring on the bottom portion of said chamber assembly engaging said at least one track for connecting said plug assembly and said chamber assembly.

12. An apparatus for selectively separating and mixing components in a baby bottle container, the apparatus comprising:

a plug assembly being removably attached to the baby bottle container, the plug assembly having:

a wall, the wall forming an inner volume, a plug extending from the wall, said plug being attached to said wall by at least one partial inner wall oriented parallel to said wall in said plug assembly, and at least one bridge connector at the distal end of one of the at least one partial inner walls, said at least one bridge connector being oriented perpendicular to said wall and suspending said plug within at least a portion of the inner volume of the plug assembly, said at least one bridge connector being oriented to facilitate a circular like flow during mixing;

a chamber assembly being removably attached to the plug assembly, the chamber assembly having an inner wall having a partition at a distal end forming an opening, said partition capable of receiving the plug to form a seal around said plug; and the chamber assembly being engaged to the plug assembly, where the chamber assembly being axially slidable to the plug assembly so that when the partition receives the plug to form the seal, the seal separates a first compartment in the chamber assembly and a second compartment in the container.

13. The apparatus of claim 12, wherein the chamber assembly is axially slidable to remove the partition from the plug so that components held separately in the first and second compartments can be mixed.

14. The apparatus of claim 12, wherein the chamber assembly has an outer wall connected to the inner wall, the inner and outer wall forming a cavity capable of receiving the plug assembly.

15. The apparatus of claim 14, wherein the partition is on an end of the inner wall, the inner wall and the partition are capable of being received by the inner volume of the plug assembly.

16. The apparatus of claim 12, wherein the plug assembly has a track for receiving the chamber assembly.

17. The apparatus of claim 12, further comprising a nipple assembly being removably attached to the chamber assembly.

18. The apparatus of claim 17 further comprising the nipple assembly, plug assembly, the chamber assembly and the baby bottle container capable of selectively separating and mixing components in the first and second compartments.

19. The apparatus of claim 12, wherein the plug assembly and the chamber assembly can be used with the baby bottle container and the nipple assembly, wherein either of the bottle container and the nipple assembly have a diameter between about 1.25 inches and about 3.25 inches.

20. The apparatus of claim 12, wherein said at least one bridge connector having a profile configured to facilitate flow of fluid through the bottle system.

* * * * *